US006394312B1

(12) United States Patent
Endou

(10) Patent No.: US 6,394,312 B1
(45) Date of Patent: May 28, 2002

(54) BEVERAGE FEEDING APPARATUS

(75) Inventor: Nobuyuki Endou, Saitama-ken (JP)

(73) Assignee: Sanyo Electric Co., Ltd., Osaka (JP)

( * ) Notice: Subject to any disclaimer, the term of this patent is extended or adjusted under 35 U.S.C. 154(b) by 0 days.

(21) Appl. No.: 09/752,825

(22) Filed: Jan. 3, 2001

(51) Int. Cl.[7] ..... B67D 5/56
(52) U.S. Cl. ..... 222/129.1; 222/63
(58) Field of Search ..... 222/71, 63, 129.1, 222/640

(56) References Cited

U.S. PATENT DOCUMENTS

| | | | | |
|---|---|---|---|---|
| 5,465,870 A | * | 11/1995 | Sizemore | 222/129.1 |
| 5,797,519 A | * | 8/1998 | Schroeder et al. | 222/129.1 |
| 6,116,460 A | * | 9/2000 | Kim et al. | 222/129.1 |
| 6,182,555 B1 | * | 2/2001 | Scheer et al. | 222/129.1 |
| 6,237,811 B1 | * | 5/2001 | Ford | 222/129.1 |

FOREIGN PATENT DOCUMENTS

| | | |
|---|---|---|
| JP | 9-301496 | 11/1997 |
| JP | 10-29698 | 2/1998 |
| JP | 11-46983 | 2/1999 |

* cited by examiner

*Primary Examiner*—Philippe Derakshani
*Assistant Examiner*—Thach H. Bui
(74) *Attorney, Agent, or Firm*—McDermott, Will & Emery

(57) ABSTRACT

There is provided a beverage feeding apparatus for mixing a stock beverage fed from a storing container with diluting water according to beverage feed operation. This apparatus comprises: a stepping motor for driving a stock beverage feed pump for feeding the stock beverage; a flow meter for generating a signal of which the period varies depending upon the amount of the diluting water passed through the flow meter; and means for properly regulating the amount of the stock beverage fed by the stock beverage feed pump by varying the period of the drive signal of the stepping motor based on the amount of the diluting water passed through the flow meter. By virtue of this construction, the beverage feeding apparatus can realize the provision of beverages at a predetermined dilution ratio even when the amount of the diluting water fed has been varied.

3 Claims, 4 Drawing Sheets

BEVERAGE FEEDING APPARATUS

FIELD OF THE INVENTION

The invention relates to a beverage feeding apparatus of the so-called "post-mix system" wherein a concentrated beverage is diluted with diluting water according to beverage feed operation. More particularly, the invention relates to a beverage feeding apparatus which can provide a beverage at a predetermined dilution ratio even when the amount of the diluting water fed has been varied by some cause.

BACKGROUND OF THE INVENTION

Among beverage feeding apparatuses for feeding various beverages through nozzles, one of representative beverage feeding apparatuses is the so-called "post-mix" system wherein a stock beverage and diluting water are fed through respective separate feed passages and are mixed together in the nozzle or a cup according to beverage feed operation. This system is disclosed, for example, in Japanese Patent Laid-Open Nos. 46983/1999 and 29698/1998.

When this beverage feeding apparatus of post-mix system is based on a selling system utilizing push button switches provided for respective types of beverages, this system is the so-called "semi-automatic selling system" wherein as soon as a person who desires the feed of a certain type of a beverage has depressed a push button switch corresponding to the desired type of beverage in such a state that a cup is placed on a table located under a feed nozzle, a control unit is operated to feed a predetermined amount of the beverage through the operation of a timer for a given period of time. This automatic selling system is the so-called "cup-type vending machine" wherein the insertion of money and the operation of a push button switch permit a cup to drop on a selling port and, in addition, a given amount of a desired beverage to be fed into the cup.

When the beverage feeding apparatus is based on a feed lever system wherein feed levers are provided for respective types of beverages, a switch is in an ON state during a period wherein a person who desires the feed of a certain type of a beverage is operating the feed lever corresponding to the desired type, thereby permitting a solenoid valve to be opened (the so-called "manual feed system").

Recently, for example, in family restaurants and fastfood restaurants, there is an ever-increasing tendency for adopting a selling system known as the so-called "free drink" as a self-service system wherein the above-described beverage feeding apparatus is installed on a place at which guests can operate the apparatus. In this case, a guest can operate a lever or a push button switch provided on the front face of the beverage feeding apparatus to freely pour a favorite beverage into a cup.

Japanese Patent Laid-Open No. 301496/1997 discloses an apparatus based on a system such that, when syrup fed from BIB (bag in box) as a container storing a certain type of syrup as a concentrated stock beverage is diluted with diluting water, the amount of syrup fed from BIB is preset through a numeric value input key, such as a ten key, and the syrup is diluted according to the dilution ratio based on the set value.

According to the method described in Japanese Patent Laid-Open No. 301496/1997, the dilution ratio is specified by the set value. When the flow rate of the diluting water falls within the specified range, a beverage having predetermined quality can be provided. On the other hand, when the amount of the diluting water has been lowered by some cause, such as leakage of the diluting water, the operation of a lever or a push button switch by a customer (or a guest) without noticing this trouble poses a problem that a beverage containing a smaller amount of diluting water than the predetermined amount, that is, a beverage having a high concentration and poor quality, is fed into the cup.

SUMMARY OF THE INVENTION

In view of the above problem of the prior art, the invention has been made, and it is an object of the invention to provide a beverage feeding apparatus which can provide a beverage at a predetermined dilution ratio even when the amount of the diluting water has been varied by some cause.

According to the first feature of the invention, a beverage feeding apparatus for mixing a stock beverage fed from a storing container with diluting water according to beverage feed operation comprises:

- a stepping motor for driving a stock beverage feed pump for feeding the stock beverage;
- a flow meter for generating a signal of which the period varies depending upon the amount of the diluting water passed through the flow meter; and
- means for varying the amount of the stock beverage fed by the stock beverage feed pump by varying the period of the drive signal of the stepping motor based on the amount of the diluting water passed through the flow meter.

According to the second feature of the invention, a beverage feeding apparatus for mixing a stock beverage fed from a storing container with diluting water according to beverage feed operation comprises:

- dilution ratio setting means for setting a predetermined dilution ratio;
- reference clock signal generating means for generating a reference clock signal of a predetermined frequency;
- a flow meter for generating a continuous signal of which the frequency varies according to the amount of the diluting water passed through the flow meter;
- frequency divider means for dividing the reference clock signal at a frequency dividing ratio based on the dilution ratio and the continuous signal to generate a frequency division signal;
- driving means for generating a drive signal of a period based on the frequency of the frequency division signal; and
- a driving motor for driving a stock beverage feed pump for feeding the stock beverage based on the drive signal,
- the period of the drive signal being varied based on the amount of the diluting water passed through the flow meter, thereby varying the amount of the stock beverage fed through the stock beverage feed pump.

According to the third feature of the invention, a beverage feeding apparatus for mixing a stock beverage fed from a storing container with diluting water according to beverage feed operation comprises:

- dilution ratio setting means for setting a predetermined dilution ratio;
- reference clock signal generating means for generating a reference clock signal of a predetermined frequency;
- a flow meter for generating a continuous signal of which the frequency varies according to the amount of the diluting water passed through the flow meter;

frequency divider means for dividing the reference clock signal according to a frequency dividing ratio based on the continuous signal to generate a frequency division signal;

driving means for generating a drive signal of a period based on the frequency of the frequency division signal; and a drive motor for driving a stock beverage feed pump for feeding the stock beverage based on the drive signal, the frequency of the frequency division signal being varied based on the continuous signal.

BRIEF DESCRIPTION OF THE DRAWINGS

The invention will be explained in more detail in conjunction with the appended drawings, wherein.

DESCRIPTION OF THE PREFERRED EMBODIMENTS

Figure 1:
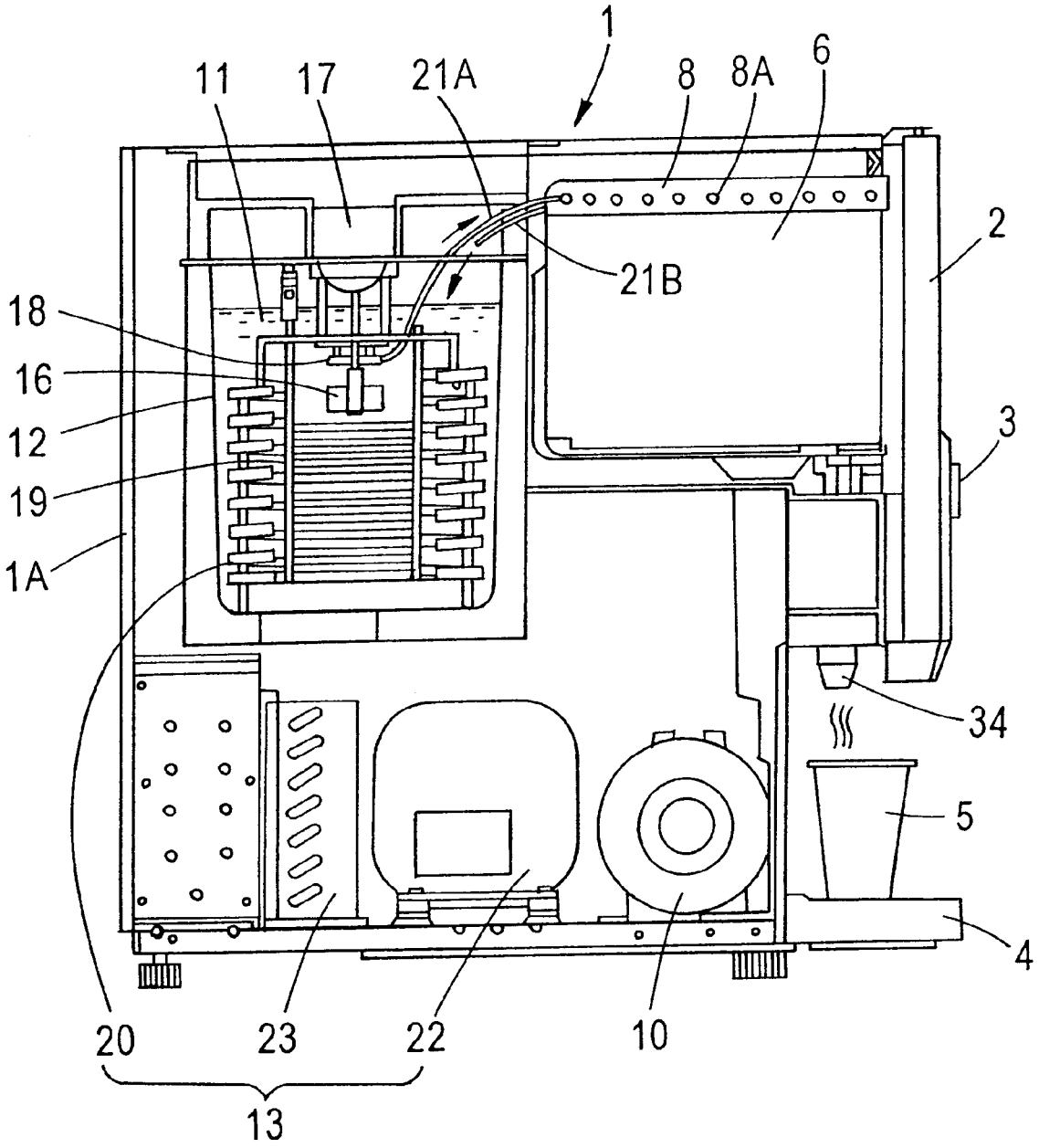
FIG. 1 is a longitudinal sectional side view of a beverage dispenser to which the beverage feeding apparatus of post-mix system according to a preferred embodiment of the invention has been applied.

Preferred embodiments of the invention will be described. FIGS. 1 to 5 show a beverage feeding apparatus of post-mix system according to a preferred embodiment of the invention, wherein FIG. 1 is a longitudinal sectional side view of a beverage dispenser to which the beverage feeding apparatus according to the invention has been applied, FIG. 2 a diagram showing a piping system of the beverage dispenser shown in FIG. 1, FIG. 3 a longitudinal sectional view of a dual check valve, FIG. 4 a block diagram showing a preferred embodiment of a dilution ratio control unit, and FIG. 5 a diagram showing a beverage feed system utilizing a plurality of BIBs.

A preferred embodiment of the post-mix system according to the invention will be explained in conjunction with FIGS. 1 to 5. Numeral 1 designates a beverage dispenser to which the beverage feeding apparatus according to the invention has been applied. This beverage dispenser has a substantially boxshaped dispenser body 1A. An openable door 2 is provided on the front of the dispenser body 1A. The openable door 2 is provided with selection switches 3 of which the number is equal to the number of types of beverages so that the type of beverage desired to be fed can be selected. A drip tray 4, on which a cup 5 can be put, is provided on the lower part of the front of the dispenser body 1A.

A cold reserving container 6 is provided on the upper part at the front within the dispenser body 1A. BIB 40, which will be described later, containing various concentrated stock beverages, and a cooler 8 having a conduit 8A for cooling water disposed in a meandrous form are disposed in the cold reserving container 6. Further, a booster pump 10 for pressurizing and feeding tap water from a water supply 9, a water tank 12 for reservoiring cooling water 11, and a cooling unit 13 for cooling the cooling water 11 contained in the water tank 12 are disposed within the dispenser body 1A.

Within the water tank 12 are disposed a carbonator 14 for mixing water and carbon dioxide together to produce carbonated water 15, an agitator motor 17 for agitating the cooling water 11 by means of a propeller 16, a circulation pump 18 mounted on the agitator motor 17, a coil unit 19 comprising a carbonated water coil through which carbonated water 15 is passed and a tap water coil through which tap water is passed, and a coolant evaporating pipe 20 for constituting the cooling unit 13.

The circulation pump 18 is connected through a cooling water pipe 21A to the inlet of the conduit 8A for cooling water in the cooler 8. A cooling water pipe 21B, which is returned to the water tank 12, is connected to the outlet of the conduit 8A for cooling water. According to this construction, the cooling water 11 contained in the water tank 12 is flowed through the circulation pump 18 from the cooling water pipe 21A into the conduit 8A for cooling water, in the cooler 8, from which the cooling water 11 is passed through the cooling water pipe 21B and is then returned into the water tank 12. Thus, the cooling water is circulated to cool BIB 40 within the cold reserving container 6.

The cooling unit 13 comprises: a compressor 22 for compressing a coolant; a condenser 23 for condensing the coolant compressed by means of the compressor 22; and an evaporator 20 for cooling cooling water 11 around the evaporator by evaporating the coolant after passage of the coolant, which has been condensed by the condenser 23, through a vacuum device (not shown).

Figure 2:
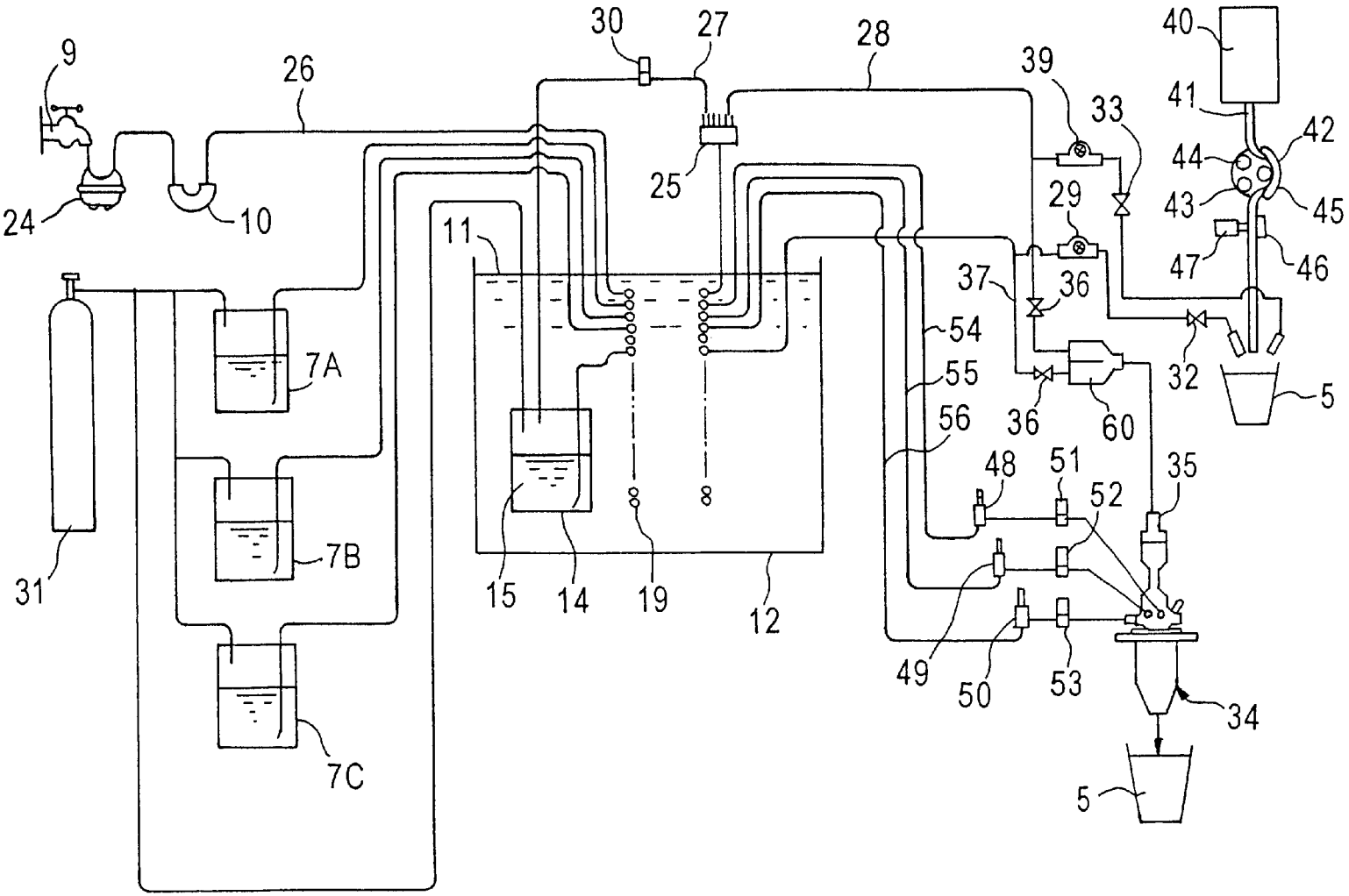
FIG. 2 is a diagram showing a piping system of the beverage dispenser shown in FIG. 1.

FIG. 2 shows a piping system for beverages. A conduit 26 is constructed so that tap water from a water supply 9 is passed through a water filter 24, a booster pump 10, and a coil unit 19, and reaches a distributor 25. The conduit 26 is branched by the distributor 25 into two conduits 27, 28 for cold water.

A conduit 27 is passed through a solenoid valve 30 for water supply to carbonator and reaches a carbonator 14. Carbon dioxide is fed from a carbon dioxide bomb 31 into the carbonator 14. Carbonated water 15 is prepared from this carbon dioxide and cooled tap water fed through the conduit 27.

Regarding the level of the carbonated water 15 within the carbonator 14, the carbonator 14 is constructed so that a predetermined amount of the carbonated water 15 is reservoired within the carbonator 14 by turning on or off the booster pump 10 and the solenoid valve 30 upon the detection of the level of the carbonated water with a level detector (not shown).

Figure 3:
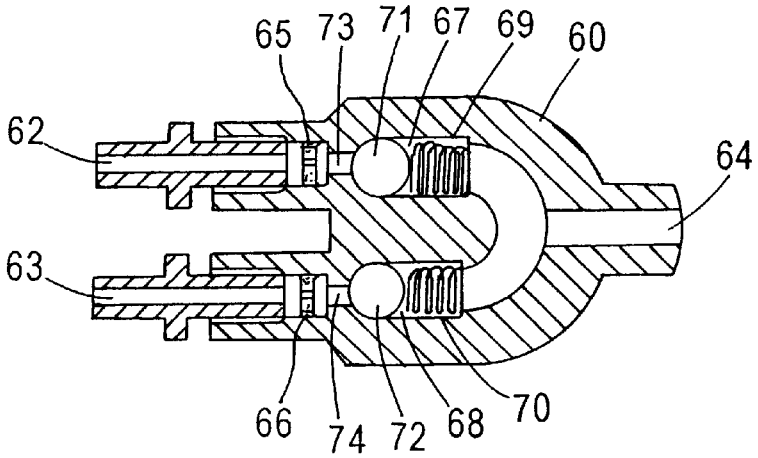
FIG. 3 is a longitudinal sectional view of a dual check valve applied to the beverage feeding apparatus according to a preferred embodiment of the invention.

Numeral 60 designates a dual check valve. The structure of the dual check valve 60 is shown in FIG. 3. As shown in FIG. 3, the dual check valve 60 has two inlets which will be described later, that is, a cold water inlet 62 into which cold water is flowed from the conduit 28, and a carbonated water inlet 63 into which carbonated water is flowed from the conduit 37, and one outlet 64. A flow washer 65 and a check valve 67 are provided between the cold water inlet 62 and the outlet 64. On the other hand, a flow washer 66 and a check valve 68 are provided between the carbonated water inlet 63 and the outlet 64. The check valves 67, 68 are respectively composed of ball valves 71, 72 energized by means of springs 69, 70 so as to close fluid passages 73, 74.

Flow washer 65 functions as a flow rate regulator which varies the sectional area of the fluid passage provided in the center portion according to the pressure of cold water introduced through the cold water inlet 62, thereby regulating the flow rate of cold water passed through the flow washer 65 at a constant value. This is true of the flow washer 66. In he check valve 67, the valve 71 pushes the spring 69 by taking advantage of the fluid introduced through the cold water inlet 62 and directed toward the outlet 64 to open the fluid passage 73, whereby the cold water introduced through the cold water inlet 62 is passed through the passage and reaches the outlet 64. In the valve 71, when the pressure in the fluid inlet relative to the pressure in the fluid outlet is lowered to less than a predetermined value, the valve 71 closes the fluid passage 73 due to the energization of the spring 69. That is, the check valve 67 functions as the so-called "nonreturn valve." This is true of the check valve 68.

A conduit is constructed so that the carbonated water 15 within the carbonator 14 is passed through a coil unit 19, a solenoid valve 38 for carbonated water, and a dual check valve 60 and is flowed into a diluting water inlet 35 in a multivalve 34 as a beverage feed nozzle. The cold water in the conduit 28 from the distributor 25 is passed through a solenoid valve 36 and a dual check valve 60 and is flowed into the diluting water inlet 35 in the multivalve 34 as the beverage feed nozzle.

Numeral 40 designates BIB (bag in box) that is a container which stores another type of syrup as a concentrated stock beverage. A tube 41 constituting a conduit for syrup is lead from the lower part of BIB 40, and the syrup present within the tube 41 led from BIB 40 is fed through a tube pump 42 into a cup 5. BIB 40 is in the state of storage under cooling within the cold reserving container 6.

The cold water as diluting water fed from the conduit 28 is passed through the flow meter 39 and the solenoid valve 33, and is fed into the cup 5. The syrup fed from BIB 40 is diluted and mixed with this cold water within the cup 5. On the other hand, when the type of syrup fed from BIB 40 is suitable for mixing with carbonated water, carbonated water as diluting water, which is fed from the conduit 37 through the flow meter 29 and the solenoid valve 32, and this syrup are fed into the cup 5 where the syrup is diluted and mixed with the carbonated water within the cup 5. Instead of the system wherein the syrup is diluted and mixed with diluting water within the cup 5, a system may be used wherein diluting water and syrup are mixed together within a certain suitable valve, such as the multivalve 34, to prepare a beverage having a predetermined concentration which is then fed into the cup 5.

Carbon dioxide from the carbon dioxide bomb 31 is fed into syrup tanks 7A, 7B, 7C respectively containing syrups A, B, C as a plurality of concentrated stock beverages (although three types in the preferred embodiment are used, four or more types may be used) which are different from one another, for example, in flavor, taste, or color. The syrups A, B, C forcibly transferred from the syrup tanks 7A, 7B, 7C by the pressure of carbon dioxide are respectively passed through conduits 54, 55, 56 for syrups provided with coil units 19, flow rate regulators 48, 49, 50, and solenoid valves 51, 52, 53, and are then flowed into the syrup inlet of the multivalve 34. Each of the solenoid valves 32, 33, 36, 38 opens the conduit for a predetermined period of time according to the beverage feed operation by the control unit to feed a predetermined amount of the cold water or carbonated water in the conduit.

Here the beverage feed of syrup A will be explained. In an ordinary state, the feed of the tap water is normal. In performing the beverage feed of syrup A, the solenoid valves 38, 51 are energized and turned on in response to the operation of the corresponding selection switch 3. This permits carbonated water and the syrup A to be fed into the multivalve 34 respectively through the conduits 32, 54. While the carbonated water and the syrup A are mixed together in the multivalve 34, a predetermined beverage are fed into a cup 5. For the syrups B and C, the construction for the operation is the same as that of the syrup A.

The tube pump 42 has a stepping motor 90, as a motor for driving a pump, which is intermittently rotated by a predetermined angle in response to a pulse signal. The tube pump 42 further comprises: a disk 43 which is mounted on an output shaft rotatable through a reduction mechanism (not shown) in response to the rotation of the stepping motor 90; three rollers 44 which are rotatably mounted on the disk 43 at intervals of 120 degrees in terms of angle; an arcuate guide 45 disposed so as to sandwich the tube 41 between the guide 45 and the roller 44; and a pinch solenoid 47 for pinching the lower end side of the tube 41 between the solenoid 47 and the pinch member 46. According to this construction, upon the rotation of the stepping motor 90, the disk 43 is rotated. This permits the tube 41 in its position pushed by the roller 44 against the arcuate guide 45 to be moved downward, thereby the syrup present within the tube 41 is squeezed out downward. When the feed of beverage is in a stopped state, the pinch solenoid 47 is in a non-energized state. In this case, the syrup within BIB 40 flows out to and stops at a portion pinched by the pinch solenoid 47. Thus, the pinch member 46 and the pinch solenoid 47 constitute the solenoid valve in the invention.

The beverage feeding apparatus according to one of the features of the invention is such that, in a beverage feeding apparatus for mixing a stock beverage fed from a storing container with diluting water according to beverage feed operation, a passage for feeding the diluting water is provided with a flow meter for generating a continuous signal of which the period varies depending upon the amount of the diluting water passed through the flow meter and a drive motor which, in response to a drive signal, drives a stock beverage feed pump for feeding the stock beverage, wherein the amount of the stock beverage fed through the stock beverage feed pump is automatically changed to a value corresponding to the amount of the diluting water passed through the flow meter. In this case, the stock beverage storing container is BIB 40, and the passage for feeding the stock beverage is the conduit 41 for syrup. The stock beverage feed pump is provided in a feed passage for the stock beverage fed from BIB 40. The diluting water is cold water or carbonated water fed from the carbonator 14.

Beverage feed operation involved in the feed of syrup from BIB 40 will be explained. The flow meters 29 and 39 are respectively rotated by carbonated water and cold water flowed through the conduits 37 and 28, that is, diluting water streams, to generate electric signals. In general, the diluting water stream rotates a paddle to generate a continuous pulse signal. The rotational period of the flow meters 29, 39, that is, the frequency of generated pulse signal, varies depending upon a variation in the diluting water stream. This results in a change in the number of pulses generated in a given period of time. For example, for the pulse signal generated in an ordinary beverage feed-selling state, the number of pulses generated per sec is about 1000.

Figure 4:
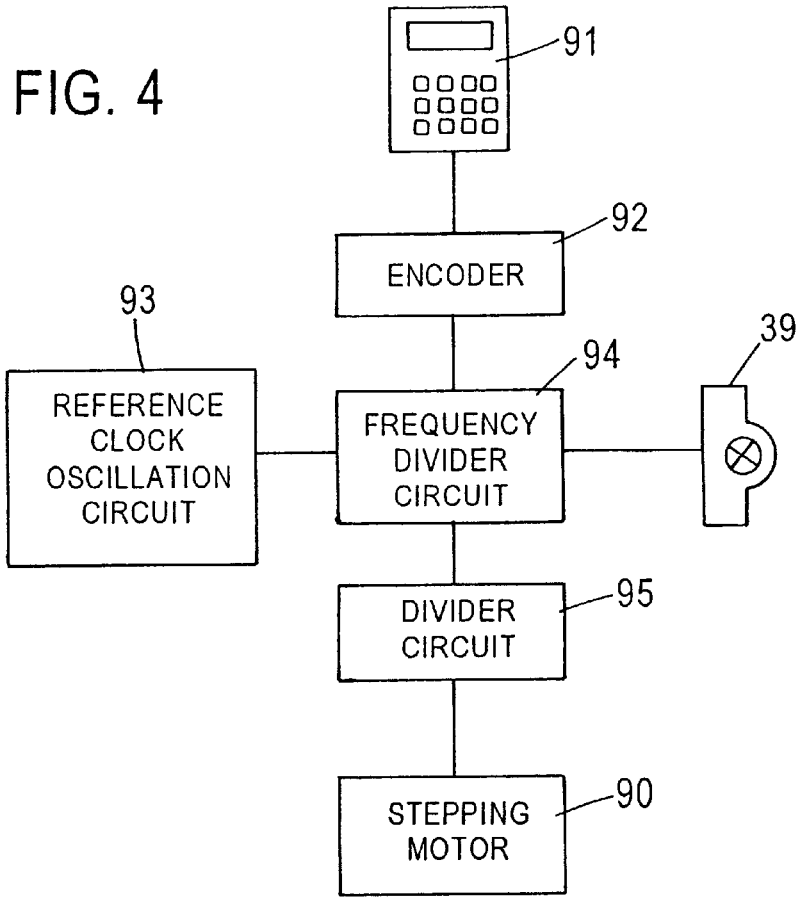
FIG. 4 is a block diagram showing a preferred embodiment of a dilution ratio control unit according to the invention.

FIG. 4 is a block diagram showing a preferred embodiment of the diluting ratio control unit according to the invention. Numeral 91 designates an input circuit comprising: a numerical value input key, such as a ten key, which is to be operated by a particular person, such as an administrator for the beverage feeding apparatus; and a memory for storing input numerical values. Numeral 92 designates an encoder which permits the input of numerical values input through the input circuit 91 and outputs 8-bit code signals (from "00000000=0" to "11111111=255"), numeral 93 a reference clock oscillation circuit for outputting a reference clock pulse signal of 10 KHz, and numeral 94 a pulse period operation part that functions as a frequency divider circuit which permits the input of the code signal from the encoder 92, divides the reference clock of 10 KHz by a predetermined division ratio (maximum division ratio: not more than 512), and outputs the resultant division clocks. Numeral 95 designates a driver circuit which permits the input of the division clocks from the pulse period operation part 94 and outputs a drive signal of, for example, 340 to 565 pps. The stepping motor 90 is constructed so that, upon the input of the pulse signal from the driver circuit 95, the stepping motor 90 is rotated by an angle of 7.5 degrees per step. The pulse signal output from the flow meter 39 is also input into the pulse period operation part 94. This permits the pulse period operation part 94 to determine the division ratio of the reference clock pulse signal based on the dilution ratio data input through the input circuit 91 and the pulse signal output from the flow meter 39. The divided pulse signal is output to the driver circuit 95 to control the rotation speed of the stepping motor 90.

When the beverage feeding apparatus adopts a selling system utilizing push buttons 3 provided for respective types of beverages, this selling system is the so-called "automatic selling system" wherein, as soon as a person, who desires the feed of a carbonated beverage from BIB 40, depresses a push button 3 corresponding to the desired type, the control unit is operated to operate the pump 42 and the solenoid valves 32, 47 for a predetermined period of time through a timer to open the conduit. According to this automatic selling system, the so-called "cup-type vending machine" is possible wherein, upon the insertion of money and the operation of the push button 3, a cup is dropped on a selling port, and a given amount of the desired beverage is fed into the cup. On the other hand, when the beverage feeding apparatus adopts a system wherein feed levers are provided for respective types of beverages, this system is the sol-called "manual feed system" wherein a switch is in an ON state during a period wherein a person who desires the feed of a carbonated beverage from BIB 40 is operating the feed lever corresponding to the desired type, whereby the control unit is operated to operate the pump 42 and the solenoid valves 32, 47 for a predetermined period of time through a timer, thereby opening the conduit.

In the above preferred embodiment, mixing syrup as a stock beverage contained in BIB 40 with carbonated water fed as diluting water from the conduit 37 to prepare a desired beverage, which is then fed, has been described. Another preferred embodiment is a system for feeding carbon dioxide-free beverage wherein cold water fed as diluting water from the conduit 28 is mixed with syrup fed from BIB 40. In this case, the system can be used as the so-called "automatic selling system" wherein, upon the operation of the corresponding selection switch 3, the control unit is operated to operate the pump 42 and the solenoid valves 33, 47 for a predetermined period of time through a timer to open the conduit. According to this automatic selling system, the so-called "cup-type vending machine" is possible wherein, upon the insertion of money and the operation of the push button 3, a cup is dropped on a selling port, and a given amount of the desired beverage is fed into the cup. When the beverage feeding apparatus adopts a system wherein feed levers are provided for respective types of beverages, this system is the sol-called "manual feed system" wherein a switch is in an ON state during a period wherein a person who desires the feed of a carbonated beverage from BIB 40 is operating the feed lever corresponding to the desired type, whereby the control unit is operated to operate the pump 42 and the solenoid valves 33, 47 for a predetermined period of time through a timer, thereby opening the conduit.

The beverage feed of syrup contained in BIB 40 will be explained in more detail. If the pressure of diluting water fed through the flow meter 39 into the cup 5 is identical to a specified value, then the flow rate of diluting water fed to the cup 5 falls within a specified flow rate range and the continuous pulse signal output from the flow meter 39 has a specified frequency (period), for example, a frequency of 1 kHz. When a 1:5 dilution of syrup with diluting water is contemplated, the dilution ratio of 5 is set in the input circuit 91. In this case, ten keys of "5" and "0" are turned on, "50" is stored in the input circuit 91 in its memory. Upon the setting of "50" in the input circuit 91, the encoder 92 converts "50" to an 8-bit code signal of "11000111=199" which is then output to the divider circuit 94. The divider circuit 94 divides the reference clock of 10 KHz output from the reference clock oscillation circuit 93 at the division ratio 200 based on the code signal "11000111=199", and outputs a division clock of 50 Hz. Upon the input of the division clock of 50 Hz, the driver circuit 95 outputs a drive signal based on which the stepping motor 90 is rotated by 7.5 degrees per step. In this ordinary state wherein the continuous signal output from the flow meter 39 outputs a specified period, that is, the above frequency of 1 kHz, the dilution is carried out at the dilution ratio set in the input circuit 91.

This rotation permits the disk 43 to be rotated through a reduction mechanism, and the position of the tube 41 pressed by the roller 44 is successively moved downward by the rotation and movement of the roller 44, whereby the syrup present within the tube 41 is fed into the cup 5 at a rate of 30 cc per sec. The syrup fed into the cup 5 is diluted and mixed with diluting water fed from the conduit 28 through the flow meter 39 and the solenoid valve 33 into the cup 5 at a dilution ratio of 5.

Figure 5:
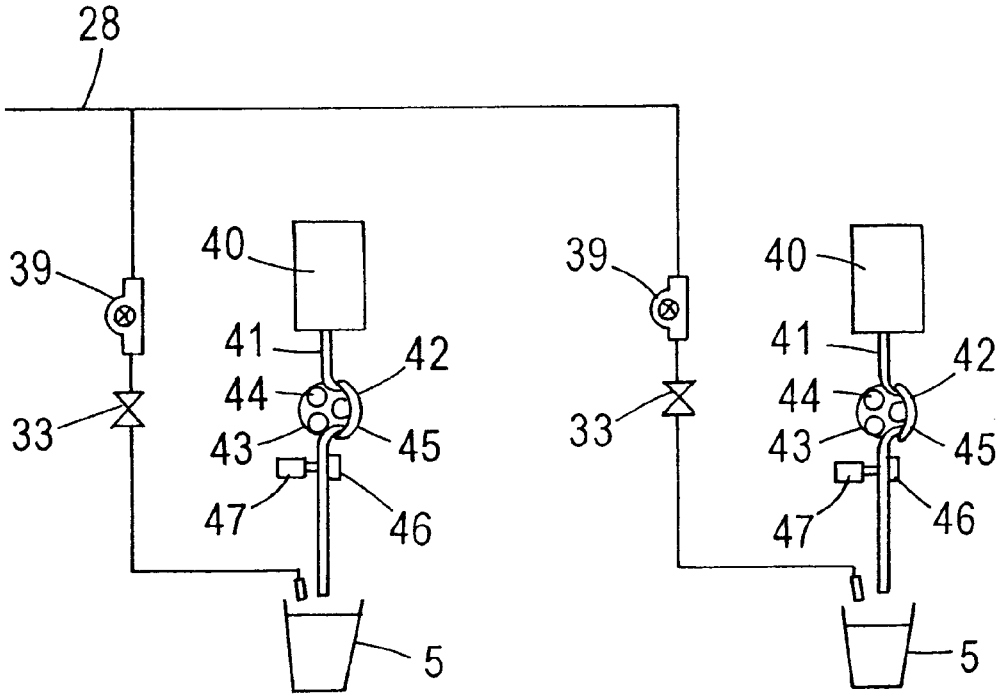
FIG. 5 is a diagram showing a beverage feed system utilizing a plurality of BIBs according to a preferred embodiment of the invention.

A system may be adopted wherein a plurality of BIBs 40 containing the same type of syrup are provided so as to realize simultaneous beverage feed. An embodiment of this system is shown in FIG. 5. In FIG. 5, two BIBs 40 containing the same type of syrup are provided. In FIG. 5, when simultaneous feed of beverage into two cups 5 is carried out, the flow rate of diluting water fed from the conduit 28 significantly varies as compared with the feed of beverage from only one BIB 40.

When the flow rate of the diluting water flowed through the flow meter 39 is less than a predetermined flow rate, for example, due to the simultaneous feed of beverage as shown in FIG. 5 or a lack of capacity caused, for example, by leakage of cold water from a cold water passage led to the flow meter 39 or malfunction of the booster pump 10, for example, when the flow rate of the diluting water is less than 24 cc, the rotation speed of the flow meter 39 is decreased and the rotation period becomes longer, resulting in longer period of the generated pulse signal. That is, the frequency of the pulse signal is lowered. In this case, for example, in the case of 0.8 kHz, the division ratio of the pulse period operation part 94 is varied according to a signal output from the flow meter 39. As a result, the division ratio is 200×(1÷0.8)=250, and a division clock (1 kHz÷250=40 Hz) smaller than the division clock of 50 Hz in the normal state is input into the driver circuit 95. The driver circuit 95 outputs a drive signal based on this to rotate the stepping motor 90 by 7.5 degrees per step. That is, in order to maintain the dilution ratio of 5 even when the flow rate of the diluting water has been decreased, the period of the drive signal becomes longer (the frequency becomes lower) and the rotation speed of the stepping motor 90 is decreased.

Upon this rotation, the disk 43 is rotated through the reduction mechanism, and the position of the tube 41 pressed by the roller 44 is successively moved downward by the rotation and movement of the roller 44, whereby the syrup present within the tube 41 is fed into the cup 5. The syrup fed into the cup 5 is diluted and mixed with diluting water fed from the conduit 28 at the set diluting water:syrup ratio of 5:1. Thus, varying the flow rate of syrup according to the flow rate of diluting water can realize the provision of beverages at a predetermined dilution ratio.

When the amount of cold water fed from the cold water feed passage led to the flow meter 39 has become equal to or larger than a predetermined value by some cause, the rotation speed of the flow meter 39 is increased. As a result, the rotation period becomes shorter, the frequency of the pulse signal generated becomes higher, and the number of pulse signals generated becomes equal to or larger than the predetermined value. In this case, the division ratio of the pulse period operation part 94 is varied by the signal output from the flow meter 39. Consequently, a division clock larger than the division clock of 50 Hz in the normal state is input into the driver circuit 95, and the driver circuit 95 outputs a drive signal based on this to rotate the stepping motor 90 by 7.5 degrees per step. That is, in order to maintain the dilution ratio of 5 even when the flow rate of the diluting water has been increased, the period of the drive signal becomes shorter (the frequency becomes higher) and the rotation speed of the stepping motor 90 is increased.

Upon this rotation, the disk 43 is rotated through the reduction mechanism, and the position of the tube 41 pressed by the roller 44 is successively moved downward by the rotation and movement of the roller 44, whereby the syrup present within the tube 41 is fed into the cup 5. The syrup fed into the cup 5 is diluted and mixed with diluting water fed through the conduit 28 at the set diluting water:syrup ratio of 5:1.

Dilution of syrup, fed from BIB 40, with cold water has been explained above. This explanation is true of the dilution of syrup, fed from BIB 40, with carbonated water fed from the conduit 37, and the division ratio can be regulated by a signal from the flow meter 29 in the same manner as described above.

The beverage feeding apparatus may not be provided with the input circuit 91. In this case, the following system may be adopted. During the operation of the beverage feeding apparatus, a specified dilution ratio is set by turning on a set switch or turning on a power source. In the same manner as described above, the division ratio of the pulse period operation part 94 is determined by the period of a signal output from the flow meters 29, 39 to control the flow rate of syrup, whereby the specified dilution ratio is realized even when the flow rate of diluting water has been varied.

According to the invention, as described above, the beverage feeding apparatus for mixing a stock beverage fed from a storing container with diluting water according to beverage feed operation comprises: a stepping motor for driving a stock beverage feed pump for feeding the stock beverage; a flow meter for generating a signal of which the period varies depending upon the amount of the diluting water passed through the flow meter; and means for varying the amount of the stock beverage fed by the stock beverage feed pump by varying the period of the drive signal of the stepping motor based on the amount of the diluting water passed through the flow meter. By virtue of this construction, beverages with a predetermined dilution level can be provided even when the amount of diluting water passed through the flow meter has been varied.

In the above preferred embodiment, a ten key was adopted as means for setting the dilution ratio. The dilution ratio setting means, however, is not limited to this only, and, alternatively, a dilution ratio setting key for designating a predetermined dilution ratio, for example, 4.5 times, 5 times, 5.5 times, 6 times . . . may be provided.

In the above preferred embodiment according to the invention, as means for varying the period of the drive signal of the drive motor for driving the stock beverage feed pump for feeding the stock beverage according to the amount of the diluting water passed through the flow meter, a method has been adopted wherein, when the input circuit 91 is provided, the value set by the input circuit 91 is varied by a signal output from the flow meters 29, 39. Alternatively, other methods may be adopted to vary the value set by the input circuit 91 by the period of a signal output from the flow meters 29, 39.

A series of these controls according to the invention are carried out through a microcomputer to properly perform the controls. More specifically, the division ratio in the pulse period operation part 94 is computed based on data corresponding to the input into the input circuit 91 and data corresponding to the signal output from the flow meters 29, 39. The frequency signal divided at this division ratio serves to control the rotation speed of the stepping motor 90 for driving the stock beverage feed pump.

An embodiment of this method is such that, when a dilution ratio of 5 is set, a reference flow rate G of syrup and a reference flow rate K of diluting water corresponding to this dilution ratio are input into the input circuit 91. In this state, when the flow rate of the diluting water from the flow meter 29 or 39 is K, the flow rate of syrup necessary for providing a dilution ratio of 5 is G. Therefore, in this case, a drive signal of a period for G is output to the stepping motor 90. When the flow rate of the diluting water is reduced to K−1, the flow rate of syrup G−1 necessary for providing a dilution ratio of 5 in relation to K−1 is computed, followed by the output of a drive signal of a frequency for G−1 to the stepping motor 90. That is, in this case, the period of the drive signal becomes longer (the frequency becomes lower), and the rotation speed of the stepping motor 90 is lowered. Thus, beverages having a proper concentration can be fed through the feed of syrup according to the flow rate of the diluting water. The above operation is true of the case where the set dilution ratio is 4 times, 6 time, . . . or the like. Further, also when the flow rate of the diluting water has been increased, beverages having a proper concentration can be fed by feeding the syrup according to the flow rate of the diluting water in substantially the same manner as described above.

At the time of start of the beverage feed operation, when the diluting water and the stock beverage are simultaneously fed, or when the start of the feed of the stock beverage is somewhat delayed as compared with the start of the feed of the diluting water, it is considered that the division ratio cannot be determined because, at the time of start of the beverage feed operation, there is no signal from the flow meter in the pulse period operation part. In order to solve this problem, a method may be adopted wherein the division ratio in the previous beverage feed operation is stored in the memory, and, at the time of start of the beverage feed operation, this division ratio in the previous beverage feed operation is used, while, upon the input of a signal from the flow meter, the division ratio is determined by this signal.

Another method for solving the above problem is as follows. When the start of feed of the diluting water is made somewhat earlier, for example, about 0.2 sec earlier, than the start of feed of the stock beverage, the division ratio can be computed and determined based on an input signal from the flow meter during this 0.2 sec period. Therefore, already at the time of start of the beverage feed operation, the division ratio can be computed and determined based on an input signal sent from the flow meter.

According to the invention, in addition to the prevention of a change in dilution level by regulating the flow rate of a stock beverage upon a variation in flow rate of the diluting water, means may be additionally provided which, when the variation in diluting water reaches a predetermined value or more, the feed of the beverage is stopped. To this end, for example, signal control means may be provided wherein, a signal from the flow meters 29, 39 (for example, frequency or rotation speed of the flow meter) is input and compared with a reference value and, when this signal value has become equal to or more than the reference value, the feed of the beverage is stopped. In this case, the manual feed system may be constructed so that, even though the switch has been operated by the feed lever, the feed operation is not carried out, while, the automatic selling system may be constructed so that the operation of the push button 3 does not start the feed operation and, at the same time, the receipt of the inserted money is rejected.

According to the invention, the period of a drive signal for a stepping motor in a stock beverage feed pump is varied according to a change in rotation of a flow meter caused by a change in the amount of diluted water passed through the flow meter. Therefore, the stock beverage can be properly fed even when the amount of the diluting water fed has been varied. By virtue of this, beverage feeding apparatuses of a post-mix system can be realized which can provide beverages having stable quality.

Further, as shown in FIG. 5, in a single beverage dispenser which can feed a plurality of types of beverages, even when the flow rate of the diluting water has been lowered by simultaneously opening a plurality of beverage feed valves, the stock beverage can be fed in a flow rate corresponding to the lowered flow rate of the diluting water. This can solve a problem of a lowering in quality of the beverage caused by the performance of a diluting water feed pump. Therefore, even when a plurality of beverage feed valves have been simultaneously opened, a desired beverage can be fed without providing a high-capacity pump which can ensure the amount of diluting water fed equal to the case where a single beverage feed vale has been opened.

Further, a high accuracy is not required of the flow rate control unit used in the regulation of the flow rate of the diluting water, and the flow rate control unit may be one having a simple structure having an orifice, or a flow washer as explained above in connection with the above preferred embodiments.

The invention has been described in detail with particular reference to preferred embodiments, but it will be understood that variations and modifications can be effected within the scope of the invention as set forth in the appended claims.

What is claimed is:

1. A beverage feeding apparatus for mixing a stock beverage fed from a storing container with diluting water according to beverage feed operation, said apparatus comprising:

a stepping motor for driving a stock beverage feed pump for feeding the stock beverage;

a flow meter for generating a signal of which the period varies depending upon the amount of the diluting water passed through the flow meter; and means for varying the amount of the stock beverage fed by the stock beverage feed pump by varying the period of the drive signal of the stepping motor based on the amount of the diluting water passed through the flow meter.

2. A beverage feeding apparatus for mixing a stock beverage fed from a storing container with diluting water according to beverage feed operation, said apparatus comprising:

dilution ratio setting means for setting a predetermined dilution ratio;

reference clock signal generating means for generating a reference clock signal of a predetermined frequency;

a flow meter for generating a continuous signal of which the frequency varies according to the amount of the diluting water passed through the flow meter;

frequency divider means for dividing the reference clock signal at a frequency dividing ratio based on the dilution ratio and the continuous signal to generate a frequency division signal;

driving means for generating a drive signal of a period based on the frequency of the frequency division signal; and a drive motor for driving a stock beverage feed pump for feeding the stock beverage based on the drive signal, the period of the drive signal being varied based on the amount of the diluting water passed through the flow meter, thereby varying the amount of the stock beverage fed through the stock beverage feed pump.

3. A beverage feeding apparatus for mixing a stock beverage fed from a storing container with diluting water according to beverage feed operation, said apparatus comprising:

dilution ratio setting means for setting a predetermined dilution ratio;

reference clock signal generating means for generating a reference clock signal of a predetermined frequency;

a flow meter for generating a continuous signal of which the frequency varies according to the amount of the diluting water passed through the flow meter;

frequency divider means for dividing the reference clock signal according to a frequency dividing ratio based on the continuous signal to generate a frequency division signal;

driving means for generating a drive signal of a period based on the frequency of the frequency division signal; and a driving motor for driving a stock beverage feed pump for feeding the stock beverage based on the drive signal, the frequency of the frequency division signal being varied based on the continuous signal.

* * * * *